United States Patent [19]

Purdy

[11] 4,099,038

[45] Jul. 4, 1978

[54] SEPARABLE ELECTRICAL FLEXIBLE CABLE ASSEMBLY FOR MOVING STORES SUCH AS MISSILES

[75] Inventor: Wilber D. Purdy, St. Charles, Mo.

[73] Assignee: The United States of America as represented by the Secretary of the Navy, Washington, D.C.

[21] Appl. No.: 753,036

[22] Filed: Dec. 22, 1976

[51] Int. Cl.[2] ..... H01H 1/12; F41F 3/04; H01R 13/62

[52] U.S. Cl. ..... 200/61.08; 89/1.811; 102/206; 339/17 F; 361/398

[58] Field of Search ..... 200/61.08; 361/397, 361/398, 409, 411, 412, 413, 414; 339/17 F, 45 M, 46; 89/1.5 R, 1.5 B, 1.5 D, 1.811; 102/70.2 R, 77, 86.2

[56] References Cited

U.S. PATENT DOCUMENTS

| | | | |
|---|---|---|---|
| 2,907,925 | 10/1959 | Pursons | 361/414 |
| 2,918,845 | 12/1959 | Fleming | 102/70.2 R X |
| 2,964,587 | 12/1960 | Minot | 339/17 F X |
| 3,067,401 | 12/1962 | Rhodes | 339/63 R |
| 3,290,756 | 12/1966 | Dreyer | 361/398 X |
| 3,477,019 | 11/1969 | Hartmann | 200/61.08 X |
| 3,519,977 | 7/1970 | Swearingen | 339/36 |
| 3,611,274 | 10/1971 | Low et al. | 89/1.811 X |
| 3,634,808 | 1/1972 | Morrison | 339/17 F X |
| 3,694,628 | 9/1972 | McGuire et al. | 219/550 |
| 3,786,173 | 1/1974 | Vogt | 174/88 S |
| 4,047,464 | 9/1977 | Fredriksson et al. | 89/1.811 |

OTHER PUBLICATIONS

Encyclopedia Britannica, "Flexible Printed Circuits", pp. 1–4; Jan. 7, 1972.

*Primary Examiner*—James R. Scott
*Attorney, Agent, or Firm*—R. S. Sciascia; Paul S. Collignon

[57] ABSTRACT

A peelaway flat cable for providing electrical connection to a missile. First and second flat cables, each having a plurality of spaced conductors, are electrically connected together and are bonded to one another. A breakaway joint is provided in the cable to provide ready separation after the cable has performed its desired function.

4 Claims, 4 Drawing Figures

SEPARABLE ELECTRICAL FLEXIBLE CABLE ASSEMBLY FOR MOVING STORES SUCH AS MISSILES

BACKGROUND OF THE INVENTION

Various civilian and military operations require electrical power to a movable object from a remotely located power source and, after launch or movement of the movable object the cable providing the power separates from the object.

One particular use of such a break-away cable is with a bomb arming device that is used for electrically arming a bomb after it is launched from an aircraft. For safety reasons, it is the practice to delay the arming of a bomb until it starts its travel away from the aircraft that is carrying the bomb. As most present day bombs are electrically armed, it is therefore necessary to have an electrical connection between the aircraft and the fuse in the bomb during part of the downward travel of the bomb. After the bomb has traveled a short distance, a switch is normally automatically closed and an electrical impulse is then received by the bomb fuse to arm the bomb. After the bomb has been armed, the electrical cable connecting the bomb and the aircraft separates and either travels with the bomb, or is retracted into the aircraft.

One type of commonly used bomb arming device is shown and described in U.S. Pat. No. 2,918,845, entitled, "Electric Arming Device." In this type of arming device, the arming cable is stowed by forming numerous bends to occupy a stowage space substantially shorter than the straight length of the stowed portion. After the arming cable is played-out a certain distance, switching means connect the bomb with a voltage source to arm the bomb. After an additional short travel, during which time a voltage is being applied to arm the bomb, the cable separates from the bomb and is carried by the aircraft.

Another bomb arming device is shown and described in U.S. Pat. No. 3,101,055, entitled, "Disposable Bomb Arming Device." In this patented device, the bomb arming device is threadedly attached to a bomb and contains a circular channel or groove on the top that holds the arming cable. The channel is provided with projecting lugs that help retain the arming cable within the groove. A single pole switch is provided within the casing of the arming device and is actuated by the movement of a pin that is retained by the arming cable portion that is within the channel. When the arming cable is withdrawn from the channel, the pin is moved outwardly and actuates a switch which closes a circuit to energize the arming unit in the bomb. Means are provided for increasing or decreasing the length of the arming cycle by the use of a pin which can be inserted into one of a plurality of slots to retain the arming cable within the circular channel.

SUMMARY OF THE INVENTION

The present invention relates to a cable which, upon application of a moderate amount of force, will separate into two pieces. The cable is comprised of first and second flat cables each having a plurality of conductors spaced in insulating material. A portion of the cables overlap and a passageway is provided between each pair of overlapping conductors. A solder preform is placed in each passageway and heated to its melting point, and upon cooling and solidification of the solder, overlapping conductors are electrically connected together. The portion of the two cables which overlap is bonded with waterproof cement. Metallic shields are provided above and below the conductors in each cable and the bottom shield of the cable is provided with a plurality of perforations in order to provide a break-away joint.

It is therefore a general object of the present invention to provide an environmentally sealed, RF shielded, electrical cable in an envelope restricted to less than 3/32 inches prior to separation.

Other objects, advantages and novel features of the present invention will become apparent from the following detailed description of the invention when considered in conjunction with the accompanying drawing.

DESCRIPTION OF THE PREFERRED EMBODIMENT

Figure 1:
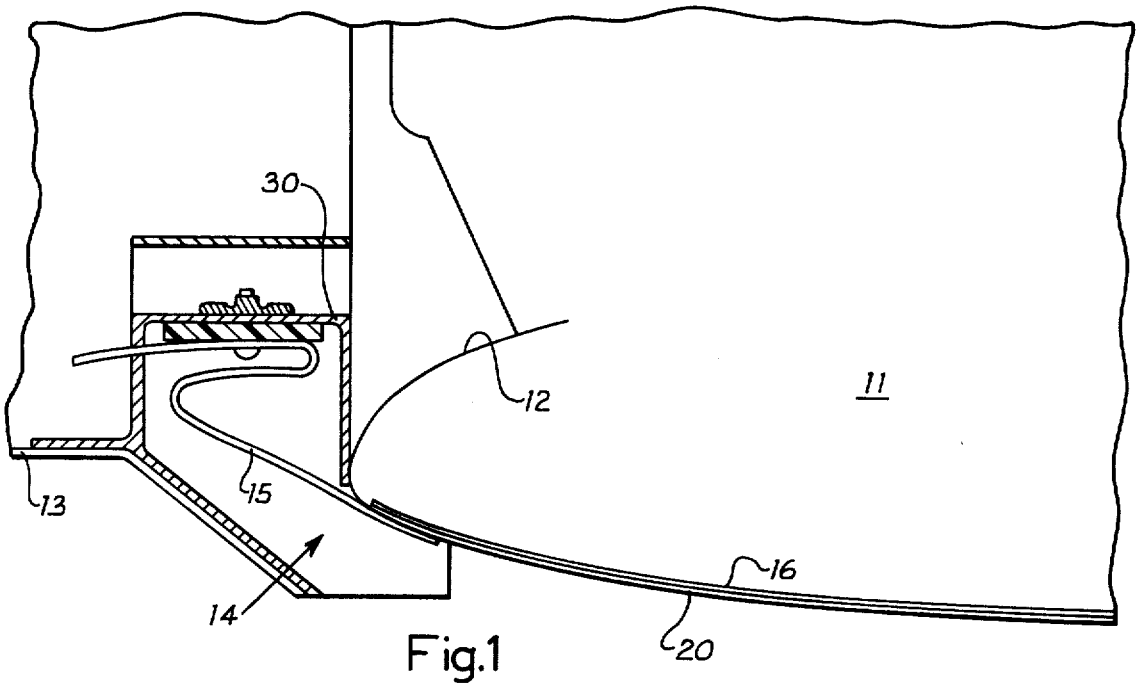
FIG. 1 is a diagrammatic view showing one use of the cable of the present invention.

Referring first to FIG. 1 of the drawing, there is illustrated one use of the present invention. A portion of a missile 11 is shown and has a motor inlet duct 12 which is closed by a cover 13. Prior to engine start, cover 13 is jettisoned by activation of a pyrotechnic device located within cover 13. Electrical energy for the pyrotechnic device is supplied to cover 13 through a flat, flexible cable 14. Cable 14 is installed such that one end is attached to the missile for a major portion of its length up to and including the area beneath a separation joint. The other end of the cable is attached mechanically to cover 13.

Figure 2:
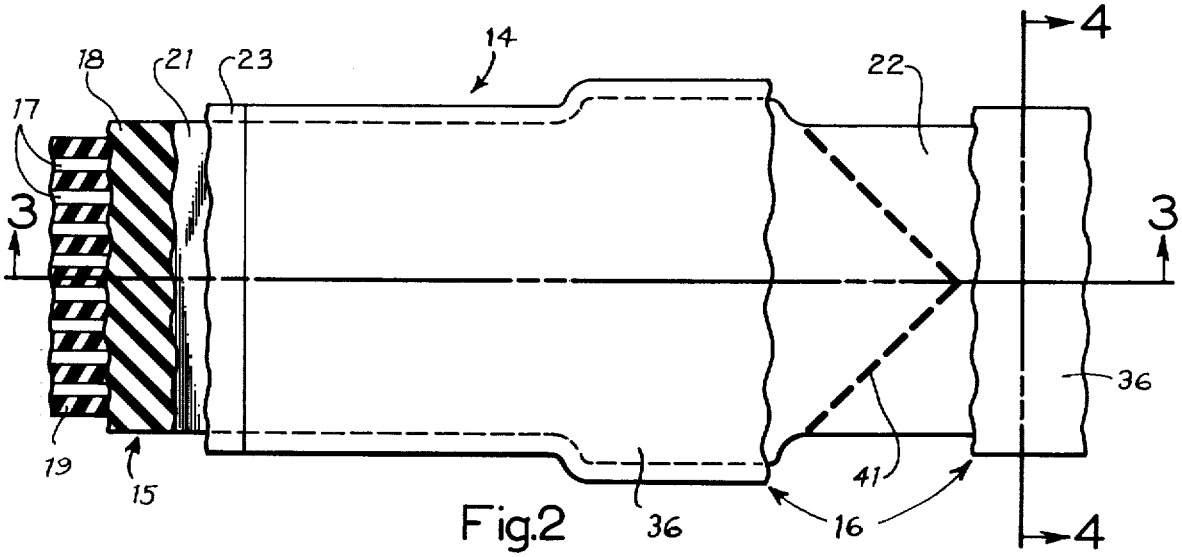
FIG. 2 is a partial top view of a preferred embodiment of the present invention.
Figure 4:
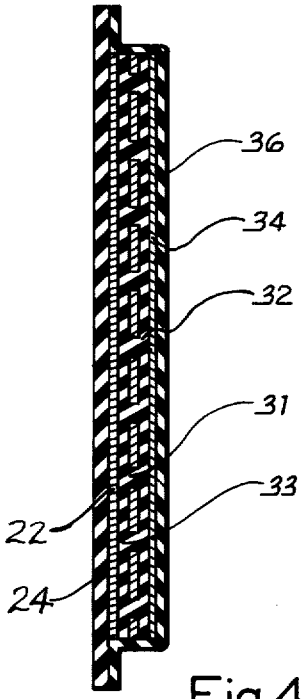
FIG. 4 is a sectional view taken on line 4—4 of FIG. 2.
Figure 3:
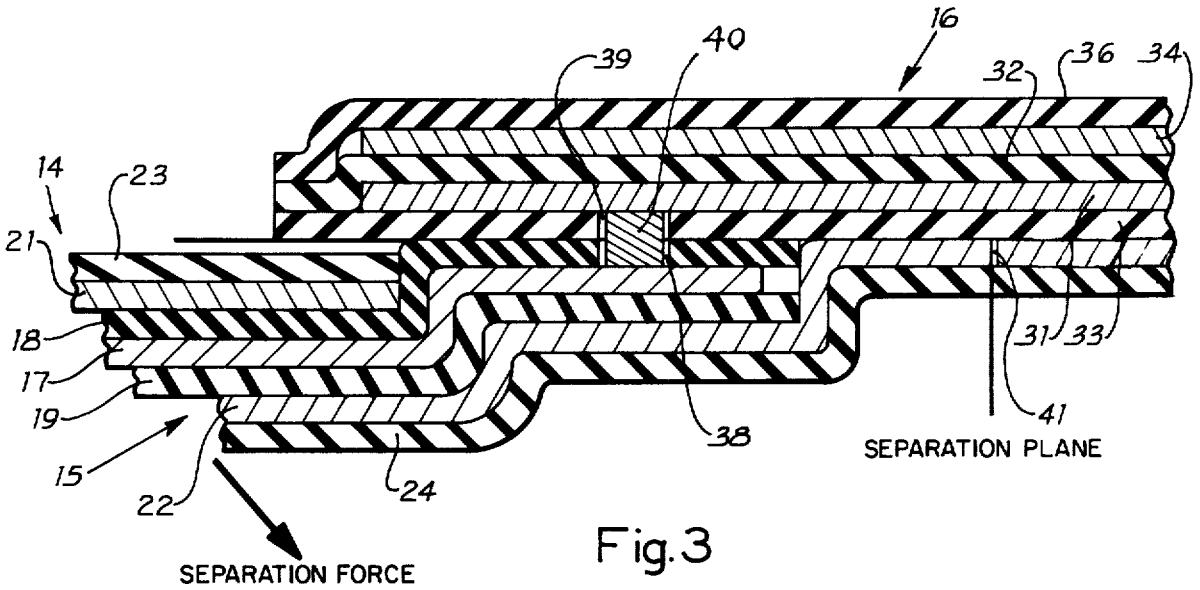
FIG. 3 is a sectional view taken on line 3—3 of FIG. 2.

Referring now to FIGS. 2 and 3 of the drawings, there is shown a flexible cable 14 comprised of flat cable sections 15 and 16. Cable 15 has a plurality of conductors 17 sandwiched between insulation layers 18 and 19. Metal shield 21 is provided above conductors 17 in order to prevent stray radiation from being picked-up and conducted by conductors 17, which radiation could trigger a circuit. Outer insulation 23 is provided to cover metal shield 21.

Cable section 16 is similar to cable section 15 and contains a plurality of conductors 31 sandwiched between insulation layers 32 and 33. Also metal shield 34 is provided above conductors 31 for radiation protection. Outer insulation layer 36 is provided adjacent metal shield 34.

As best shown in FIG. 3 of the drawing, each conductor 31 in cable 16 is aligned with a corresponding conductor 17 in cable 15 and a corresponding pair of conductors are electrically connected to one another at the separation area. Insulation layer 18 is provided with a plurality of holes 38 and, likewise, insulation layer 33 is provided with a plurality of holes 39. Holes 38 are aligned with holes 39 to provide a passageway for corresponding conductors 17 and 31, and these corresponding conductors are electrically connected together through these passageways. By way of example, solder preforms 40 are placed in these passageways and then heated so that the solder reflows and, upon solidifcation, connects corresponding conductors in cables 15 and 16. The portion of insulation layers 18 and 33 in the separation area are bonded together with waterproof cement to effect a moisture seal. After bonding cables 15 and 16 in the separation area, metal shield 22 and insulation layer 24 are bonded to cables 15 and 16 to complete the cable radiation and insulation shielding.

In the embodiment shown in FIGS. 2 and 3 of the drawing, cable 16 is designed to be attached, as by bonding, to a bulkhead and, during operation, a separation force is applied to cable 15. Metal shield 22 in cable 14 provides radiation protection for the cable conductors and also provides considerable strength to the cable. A plurality of perforations 41 are provided in metal shield 22 to provide a breakaway joint. As best shown in FIG. 2 of the drawing, perforations 41 are arranged in an angular pattern so that the rupture of cable 15 occurs in a progressive manner.

OPERATION

The operation of the present invention will be described in relation to its use with a missile, as shown in FIG. 1 of the drawing. It being understood, of course, that various other use of the peelaway cable could be readily made within the scope of the invention.

Cable section 16 is shown lying in a channel 20 in missile 11 and is secured therein as by bonding with a waterproof cement. Cable section 15 extends into cover 13 and is mechanically and electrically connected to a terminal board 30. Prior to engine start of missile 11, an electrical signal is supplied through cable 14 to a pyrotechnic device located within cover 13. Cover 13 is jettisoned by activation of the pyrotechnic device and, as the cover moves away from the main body of missile 11, a separation force is applied to cable section 15 and cable section 15 peels away from cable section 16 and separates.

Prior to separation of cable sections 15 and 16, cable 14 provides an environmental seal to the conductors therein and also provides RF shielding. After separation, the conductors in cable section 16 remain isolated.

Obviously many modifications and variations of the present invention are possible in the light of the above teachings. It is therefore to be understood that within the scope of the appended claims the invention may be practiced otherwise than as specifically described.

I claim:

1. A peelaway flat cable assembly for providing a separable electrical connection to a movable store comprising, a first thin and wide flat cable of insulating material having a plurality of parallel conductors spaced apart therein along the wide dimension of said thin and wide flat cable, a second thin and wide flat cable of insulating material having a plurality of parallel conductors spaced apart therein along the wide dimension of said second thin and wide flat cable and equal in number to the number of spaced conductors in said first flat cable, one wide end portion of said first thin and wide flat cable being overlapped and bonded to one wide end portion of said second thin and wide flat cable and positioned such that said spaced conductors in said first flat cable are aligned above said spaced conductors in said second flat cable, a first thin and wide metallic shield having a wide side bonded to both said first and second flat cables on the wide sides below said plurality of conductors and a second thin and wide metallic shield having a wide side bonded to both said first and second flat cables on the wide sides above said plurality of conductors whereby all of said conductors are positioned between said first and second metallic shields, a plurality of holes in said insulating material in the overlapped areas of said first and second flat cables, one hole communicating with each conductor to provide passageways between aligned conductors in said first flat cable and conductors in said second flat cable and solidified solder in each said passageway and in electrical contact with each aligned pair of conductors, and a plurality of perforations through said wide side of said first metallic shield for providing a breakaway joint for severing said flat cable assembly when a force is applied thereto.

2. A peelaway flat cable assembly for providing a separable electrical connection to a movable store as set forth in claim 1 wherein said first and second thin and wide flat cables are bonded with waterproof cement.

3. A peelaway flat cable assembly for providing a separable electrical connection to a movable store comprising, a first thin and wide flat cable of insulating material having a plurality of parallel conductors spaced apart therein along the wide dimension of said thin and wide flat cable, a second thin and wide flat cable of insulating material having a plurality of parallel conductors spaced apart therein along the wide dimension of said second thin and wide flat cable and equal in number to the number of spaced conductors in said first flat cable, one wide end portion of said first thin and wide flat cable being overlapped and bonded to one wide end portion of said second thin and wide flat cable and positioned such that said spaced conductors in said first flat cable are aligned above said spaced conductors in said second flat cable, a first thin and wide metallic shield having a wide side bonded to both said first and second flat cables on the wide sides below said plurality of conductors and a second thin and wide metallic shield having a wide side bonded to both said first and second flat cables on the wide sides above said plurality of conductors whereby all of said conductors are positioned between said first and second metallic shields, means in the overlapped areas of said first and second flat cables for electrically connecting each aligned pair of conductors, and a plurality of perforations through said wide side of said first metallic shield for providing a breakaway joint for severing said flat cable assembly when a force is applied thereto.

4. A peelaway flat cable assembly for providing a separable electrical connection to a moveable store as set forth in claim 3 wherein said first and second thin and wide flat cables are bonded with waterproof cement.

* * * * *